US009177490B2

(12) United States Patent
Emoff

(10) Patent No.: US 9,177,490 B2
(45) Date of Patent: Nov. 3, 2015

(54) FOLDABLE DISPLAY

(71) Applicant: Outta The Box Dispensers, LLC, Dayton, OH (US)

(72) Inventor: Michael J. Emoff, Dayton, OH (US)

(73) Assignee: Outta The Box Dispensers, LLC, Dayton, OH (US)

( * ) Notice: Subject to any disclaimer, the term of this patent is extended or adjusted under 35 U.S.C. 154(b) by 0 days.

(21) Appl. No.: 14/157,721

(22) Filed: Jan. 17, 2014

(65) Prior Publication Data

US 2014/0215869 A1 Aug. 7, 2014

Related U.S. Application Data

(60) Provisional application No. 61/759,612, filed on Feb. 1, 2013.

(51) Int. Cl.
*G09F 1/06* (2006.01)
*G09F 1/04* (2006.01)

(52) U.S. Cl.
CPC ..... *G09F 1/04* (2013.01)

(58) Field of Classification Search
CPC ..... G09F 1/04; G09F 1/06; G09F 1/08
USPC ..... 40/124.14
See application file for complete search history.

(56) References Cited

U.S. PATENT DOCUMENTS

| | | | | | |
|---|---|---|---|---|---|
| 359,150 | A * | 3/1887 | Hagelberg | 248/459 |
| 2,984,031 | A * | 5/1961 | Giesecke | 40/649 |
| 3,120,685 | A * | 2/1964 | Shears | 24/67 R |
| 3,711,977 | A * | 1/1973 | Blankenhorn | 40/124.05 |
| 4,130,197 | A * | 12/1978 | Fox | 206/45.26 |
| 4,161,074 | A * | 7/1979 | DePinna | 40/124.05 |
| 4,179,138 | A * | 12/1979 | Bogdanovic | 281/44 |
| 4,228,904 | A * | 10/1980 | Dumond | 211/55 |
| 4,471,544 | A * | 9/1984 | Nelles et al. | 40/649 |
| 4,528,800 | A * | 7/1985 | Burns | 53/492 |
| 4,919,377 | A * | 4/1990 | Alexander et al. | 248/223.41 |
| D338,241 | S * | 8/1993 | Landa | D20/43 |
| 6,360,465 | B1 * | 3/2002 | Simpson | 40/638 |
| 6,725,588 | B1 * | 4/2004 | Swoboda | 40/124.08 |
| 7,036,256 | B2 * | 5/2006 | Carlin et al. | 40/610 |
| 7,150,118 | B1 * | 12/2006 | Benton et al. | 40/610 |
| 7,527,235 | B2 * | 5/2009 | Hummel | 248/459 |
| 7,712,240 | B2 * | 5/2010 | Gipson | 40/783 |
| 8,763,288 | B2 * | 7/2014 | Emoff | 40/539 |
| 2005/0155259 | A1 * | 7/2005 | Virvo | 40/124.09 |
| 2007/0220786 | A1 * | 9/2007 | Vick et al. | 40/124.01 |
| 2012/0131825 | A1 * | 5/2012 | Hoy | 40/124.14 |
| 2014/0061288 | A1 * | 3/2014 | Dashe | 229/100 |
| 2014/0215869 | A1 * | 8/2014 | Emoff | 40/124.14 |

* cited by examiner

*Primary Examiner* — Shin Kim
(74) *Attorney, Agent, or Firm* — Walters & Wasylyna LLC

(57) ABSTRACT

A display may include a body having a first peripheral edge, a second peripheral edge, a third peripheral edge, and a fourth peripheral edge, the body may further include a first fold line defining a first panel and a second panel, a second fold line defining a first flap, a third fold line defining a second flap, a first notch disposed along the first or the second peripheral edge between the first fold line and the second fold line, and a second notch disposed along the first or the second peripheral edge between the first fold line and the third fold line, wherein, when folded, the third peripheral edge is aligned within the first notch and the fourth peripheral edge is aligned within the second notch to define an angle between the first panel and the second panel.

19 Claims, 11 Drawing Sheets

FOLDABLE DISPLAY

PRIORITY

This application claims priority from U.S. Ser. No. 61/759,612 filed on Feb. 1, 2013, the entire contents of which are incorporated herein by reference.

FIELD

The present disclosure is generally related to advertising displays and, more particularly, to foldable advertising displays having an integral alignment guide.

BACKGROUND

Placard advertising is well known in the art as an effective way to advertise products at point-of-sale, in retail aisles, and other similar locations. For example, many manufacturers and retailers desire to take advantage of the attention of consumers as they browse coolers, freezers, shelves, and the like. As another example, many manufacturers and retailers desire to take advantage of the attention of consumers as they use "pay at the pump" systems, such as those seen at gas stations, particularly since consumers equipped with a credit card have little or no reason to enter the convenience store accompanying the gas station. The use of placard advertising at such locations may provide an enticement to bring the consumer into the store or purchase additional retail items. Use of dispensing devices to provide coupons or other marketing materials in conjunction with the placard advertising may provide additional enticement to the consumer.

One disadvantage to such placard advertising is that if adequate time and care is not provided, the advertising display can appear misaligned and sloppy, which detracts from the otherwise professional appearance of the retail establishment. Another disadvantage is the limited space typically available for such displays, particularly when displays are mounted to cooler or freezer doors or shelving within aisles of a store where they can be damaged or torn down by passing costumers or when mounted to outdoor structures where wind and weather can detach the display.

Accordingly, those skilled in the art continue with research and development efforts in the field of advertising and displays.

SUMMARY

In one embodiment, the disclosed display may include a body having a first peripheral edge, a second peripheral edge opposite the first peripheral edge, a third peripheral edge extending between the first and second peripheral edges, and a fourth peripheral edge extending between the first and second peripheral edges opposite the third peripheral edge, the body may further include a first fold line defining a first panel and a second panel, a second fold line spaced apart from the first fold line defining a first flap, a third fold line spaced apart from the first fold line defining a second flap, a first notch disposed along the second peripheral edge between the first fold line and the second fold line, and a second notch disposed along the second peripheral edge between the first fold line and the third fold line, wherein the first panel is foldable relative to the second panel along the first fold line, the first flap is foldable relative to the first panel along the second fold line, and the second flap is foldable relative to the second panel along the third fold line, and wherein, when folded, the third peripheral edge is aligned within the first notch and the fourth peripheral edge is aligned within the second notch to define an angle between the first panel and the second panel.

In another embodiment, the disclosed folded display may include a body having a first peripheral edge, a second peripheral edge opposite the first peripheral edge, a third peripheral edge extending between the first and second peripheral edges, and a fourth peripheral edge extending between the first and second peripheral edges opposite the third peripheral edge, the body may further include a first fold defining a first panel and a second panel, the first panel being disposed at an angle relative to the second panel, a second fold line spaced apart from the first fold line defining a first flap, the first flap being disposed at an angle relative to the first panel, a third fold line spaced apart from the first fold line defining a second flap, the second flap being disposed at an angle relative to the second panel, a first notch disposed along the second peripheral edge between the first fold line and the second fold line, and a second notch disposed along the second peripheral edge between the first fold line and the third fold line, wherein the third peripheral edge is aligned within the first notch and the fourth peripheral edge is aligned within the second notch to define the angle between the first panel and the second panel.

In yet another embodiment, the disclosed display may include a first panel connected to a second panel along a first fold line, a first flap connected to the first panel along a second fold line, the second fold line being parallel to and spaced apart from the first fold line, a second flap connected to the second panel along a third fold line, the third fold line being parallel to and spaced apart from the first fold line, a first notch disposed on a peripheral edge of the first panel, and a second notch disposed on a peripheral edge of the second panel, wherein the first panel is foldable relative to the second panel along the first fold line, the first flap is foldable relative to the first panel along the second fold line, and the second flap is foldable relative to the second panel along the third fold line, and wherein, when folded, a peripheral edge of the first flap is aligned within the first notch and a peripheral edge of the second flap is aligned within the second notch to define an angle between the first panel and the second panel.

Other embodiments of the disclosed display will become apparent from the following detailed description, the accompanying drawings and the appended claims.

DETAILED DESCRIPTION

Figure 1:
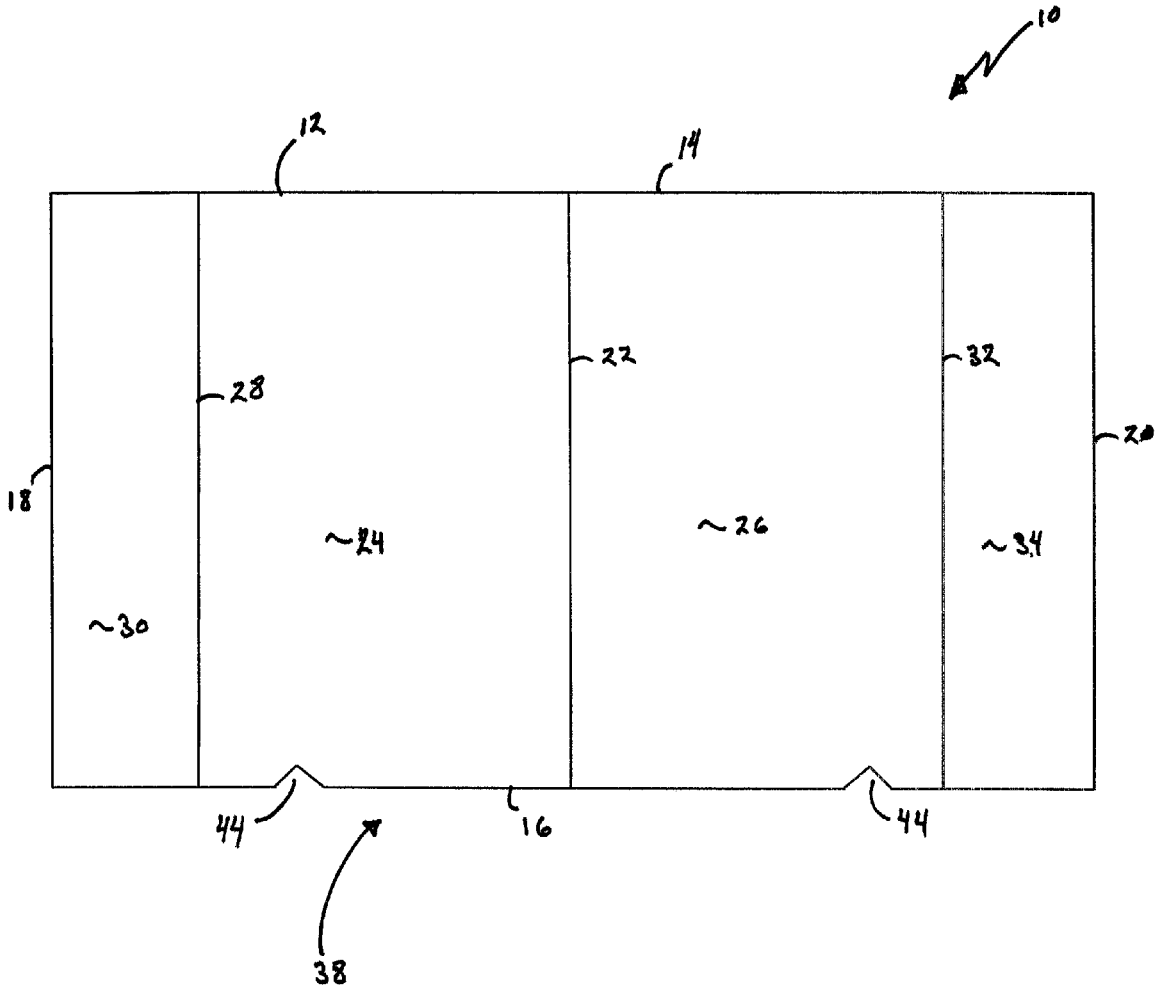
FIG. 1 is a front elevational view of one embodiment of the disclosed display depicted in a flattened configuration.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Referring to FIG. 1, one embodiment of the disclosed display, generally designated 10, may include a unitary substrate body 12 having a first (i.e., upper) peripheral edge 14, a second (i.e., lower) peripheral edge 16, a third (i.e., left) peripheral edge 18, and a fourth (i.e., right) peripheral edge 20. The body 12 may include a first fold line 22 extending laterally (i.e., vertically) between the first and second peripheral edges 14, 16. The first fold line 22 may define a first (i.e., left) panel 24 and a second (i.e., right) panel 26. In one implementation, the first fold line 22 may extend through the middle of the body 12, dividing the body 12 generally in half. Thus, the first panel 24 and the second panel 26 may generally be identical in size and shape.

The body 12 may also include a second fold line 28 extending laterally between the first and second peripheral edges 14, 16. The second fold line 28 may be generally parallel with and spaced apart from said first fold line 22 and defines a first (i.e., left) flap 30. In one implementation, the second fold line 28 may extend through the body 12 and may be positioned between the first fold line 22 and the third peripheral edge 18. The position of the second fold line 28 relative to the first fold line 22 and the third peripheral edge 18 may define the width of the first panel 24 and the first flap 30.

The body 12 may also include a third fold line 32 extending laterally between the first and second peripheral edges 14, 16. The third fold line 32 may be generally parallel with and spaced apart from said first fold line 22 and defines a second (i.e., right) flap 34. In one implementation, the third fold line 32 may extend through the body 12 and may be positioned between the first fold line 22 and the fourth peripheral edge 20. The position of the third fold line 32 relative to the first fold line 22 and the fourth peripheral edge 20 may define the width of the second panel 26 and the second flap 34.

The fold lines 22, 28, 32 may be formed by any suitable method. In one implementation, the fold lines 22, 28, 32 may be formed by an indentation or crease along the body 12. In another implementation, the fold lines 22, 28, 30 may be formed by at least partially scoring the body 12. In another implementation, the fold lines 22, 28, 32 may be formed by at least partially perforating the body 12. In yet another implementation, living hinges formed through the body 12 may define the fold lines 22, 28, 32.

Alternatively, in another embodiment of the disclosed display 10, the body 12 may include a plurality of attached panels. For example, body 12 may be formed by connecting the first panel 24 and the second panel 26 about the first fold line 22, connecting the first panel 24 and the first flap 30 about the second fold line 28, and connecting the second panel 26 and the second flap 34 about the third fold line 32. Each panel 24, 26 and flap 30, 34 may be formed from a variety of suitable substrate materials as discussed above. The fold lines 22, 28, 32 may form a hingeable joint for attaching or otherwise connecting separate panels of substrate material along aligned, adjacent edges. For example, the fold lines 22, 28, 32 may include any sufficiently flexible material connected to adjoining edges of the panels 24, 26 and the flaps 30, 32 to create a hingeable joint therebetween.

The first fold line 22 may be generally straight and may extend from a first point of the body 12 (i.e., where a top edge of the first panel 24 meets an adjoining top edge of the second panel 26) to a laterally opposed second point of the body 12 (i.e., where a bottom edge of the first panel 24 meets an adjoining bottom edge of the second panel 26). Similarly, each of the second fold line 28 and third fold line 32 may be generally straight and may extend from a first point of the body 12 (i.e., where a top edge of the panel 24, 26 meets an adjoining top edge of a corresponding flap 30, 34) to a laterally opposed second point of the body 12 (i.e., where a bottom edge of the panel 24, 26 meets an adjoining bottom edge of a corresponding flap 30, 34). Alternatively, the fold lines 22, 28, 32 may extend only partially through the body 12.

Those skilled in the art will appreciate that a variety of substrate materials may be used to form the body 12. The substrate material may be selected based upon various factors, such as weight, thickness, rigidity, or cost as well as whether the display 10 will be utilized in an indoor or outdoor environment. When the display 10 is used for the purpose of indoor advertising, the body 12 may be formed of any suitable, generally lighter weight substrate material. When the display 10 is used for the purpose of outdoor advertising, the body 12 may be formed of any suitable, generally heavier weight substrate material capable of withstanding outdoor conditions. The body 12 may include various finishes, such as gloss, matte, and the like. The body 12 may optionally be coated with a weather resistant or water resistance coating.

In one implementation, the body 12 may be formed of any suitable paper material, such as lightweight, heavyweight, coated, uncoated, paperboard, cardstock, cardboard, and the like or any combination thereof. In another implementation, the body 12 may be formed of any suitable plastic or polymeric material, such as a semi-rigid plastic sheet, a polymeric corrugated board, and the like or any combination thereof. In another implementation, the body 12 may be formed of other non-polymeric materials, such as textiles, fiberboard, metal, or laminated materials.

One general, non-limiting example of a suitable substrate material for forming the body 12 selected for indoor advertising may be a coated paper cardstock. One general, non-limiting example of a suitable substrate material for forming the body 12 selected for outdoor use may be polymeric corrugated board. One specific, non-limiting example of a suitable substrate for forming the body 12 for outdoor use may be a polymer-based, extruded twinwall corrugated board produced from high-impact polypropylene resin, such as CORO-PLAST® board available from Coroplast, Inc. of Dallas, Tex.

The body 12 may be formed by any formation process or method now known or later developed, such as die-cutting a blank of the substrate material in accordance with substrate or sheet material cutting processes. Further, the body 12 may be formed to include various shapes or sizes. Additionally, the substrate material may include any color or combination of colors.

The substrate material of the body 12 may be sufficiently flexible or malleable to allow the body 12 to be scored, folded, creased, bent, molded or otherwise formed in a manner consistent with the present disclosure to form the fold lines 22, 28, 32 without tearing or ripping of the body 12.

Figure 10:
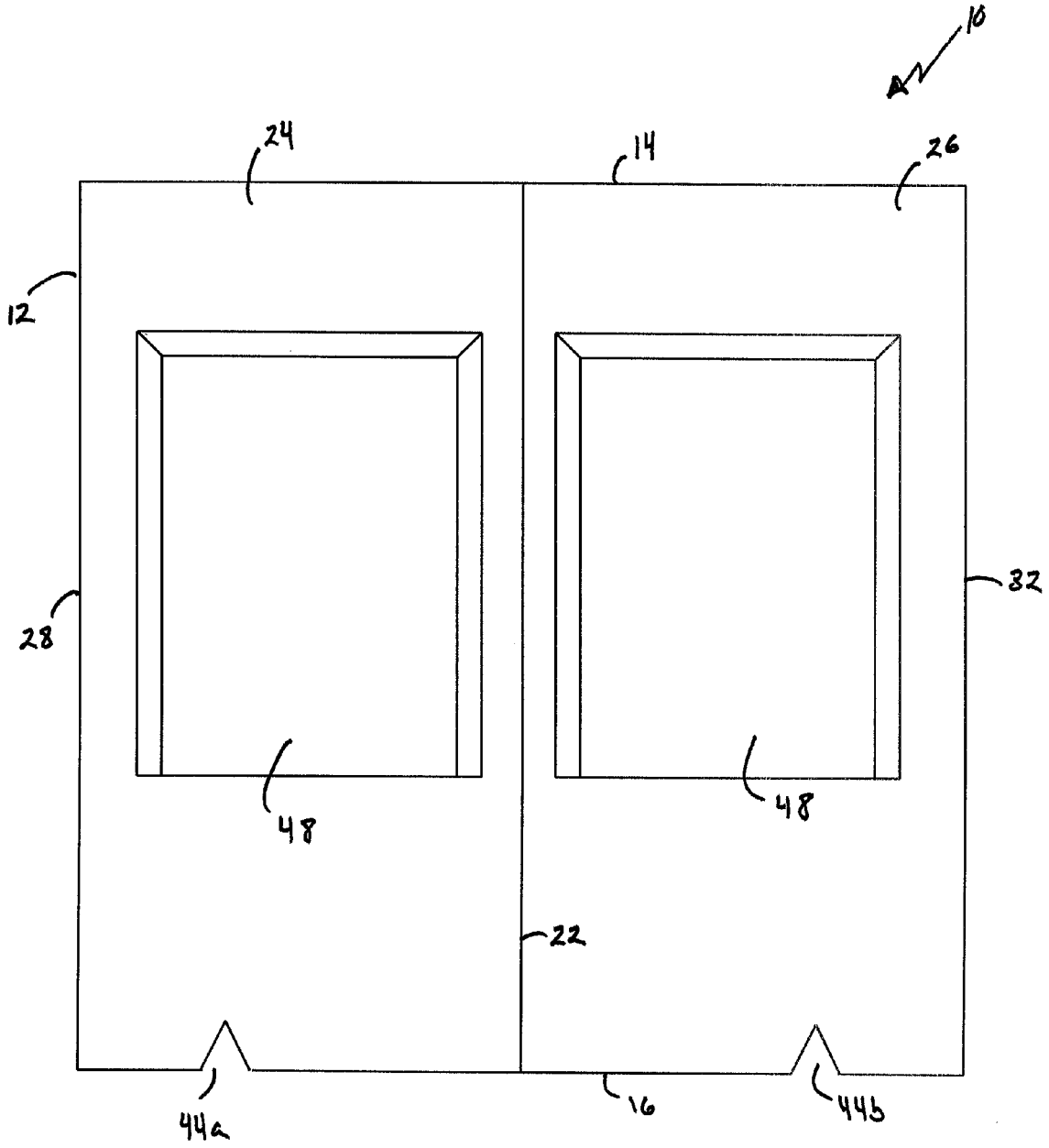
FIG. 10 is a front elevational view of another embodiment of the disclosed display depicted in the folded configuration.

The substrate material of the body 12 may also have a suitable stiffness or rigidity in order to use the body 12 as a self-support structure for printed advertising indicia. Additionally, in certain applications, the substrate material may have a suitable stiffness or rigidity in order to use the body 12 as a support structure for one or more attached dispensers. For example, the body 12 may be suitably stiff or rigid enough to support at least one dispensing device 48 (FIG. 10).

When a corrugated substrate material is used, the fold lines 22, 28, 30 may be aligned with the fluting of the corrugated substrate (i.e., in a direction perpendicular to the arc direction of a fluted sheet disposed between a pair of liner boards) in order to make the body 12 easy to fold about the fold lines 22, 28, 30.

Figure 2:
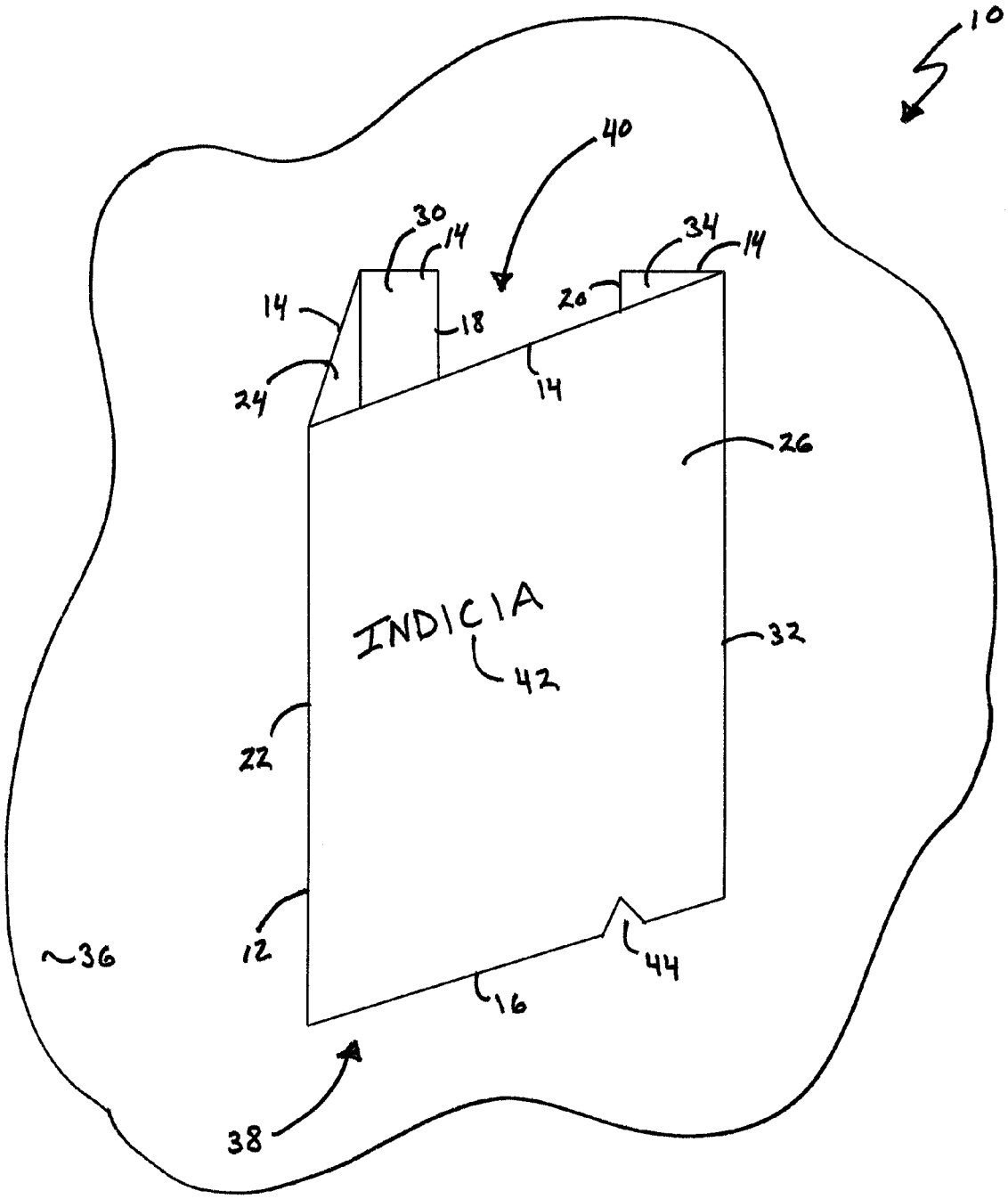
FIG. 2 is a perspective view of the disclosed display depicted in a folded configuration as attached to a support surface.

Referring to FIG. 2, the display 10 may be used as a preprinted advertising display mounted or attached to a suitable support surface 36. For example, the support surface 36 may be a surface of a cooler or freezer door in a retail store. As another example, the support surface 36 may be a surface on a gasoline pump at a filling station. As another example, the support surface 36 may be a surface of a shelf or a display stand in a retail store.

The body 12 may include a front face 38 defined by one surface of the substrate material and a rear face 40 defined by an opposing surface of the substrate material. The front face 38 may generally be the outwardly facing surface and may be at least partially visible when the body 12 is folded and attached to the support surface 36.

In use, the body 12 may be folded about the first fold line 22 to form the first panel 24 and the second panel 26. The body 12 may be folded with the first flap 30 and the second flap 34 approaching each other such that the front face 38 is exposed. The body 12 may be folded about the second fold line 28 to form the first flap 30 and folded about the third fold line 32 to form the second flap 34. The first and second flaps 30, 34 may be folded inwardly such that the front face 38 is exposed. When folded, the body 12 may form a generally triangularly shaped structure. The body 12 may be folded along the first fold line 22 such that the front face 38 of the first panel 24 generally faces in the opposite direction as the front face 38 of the second panel 26.

Figure 3:
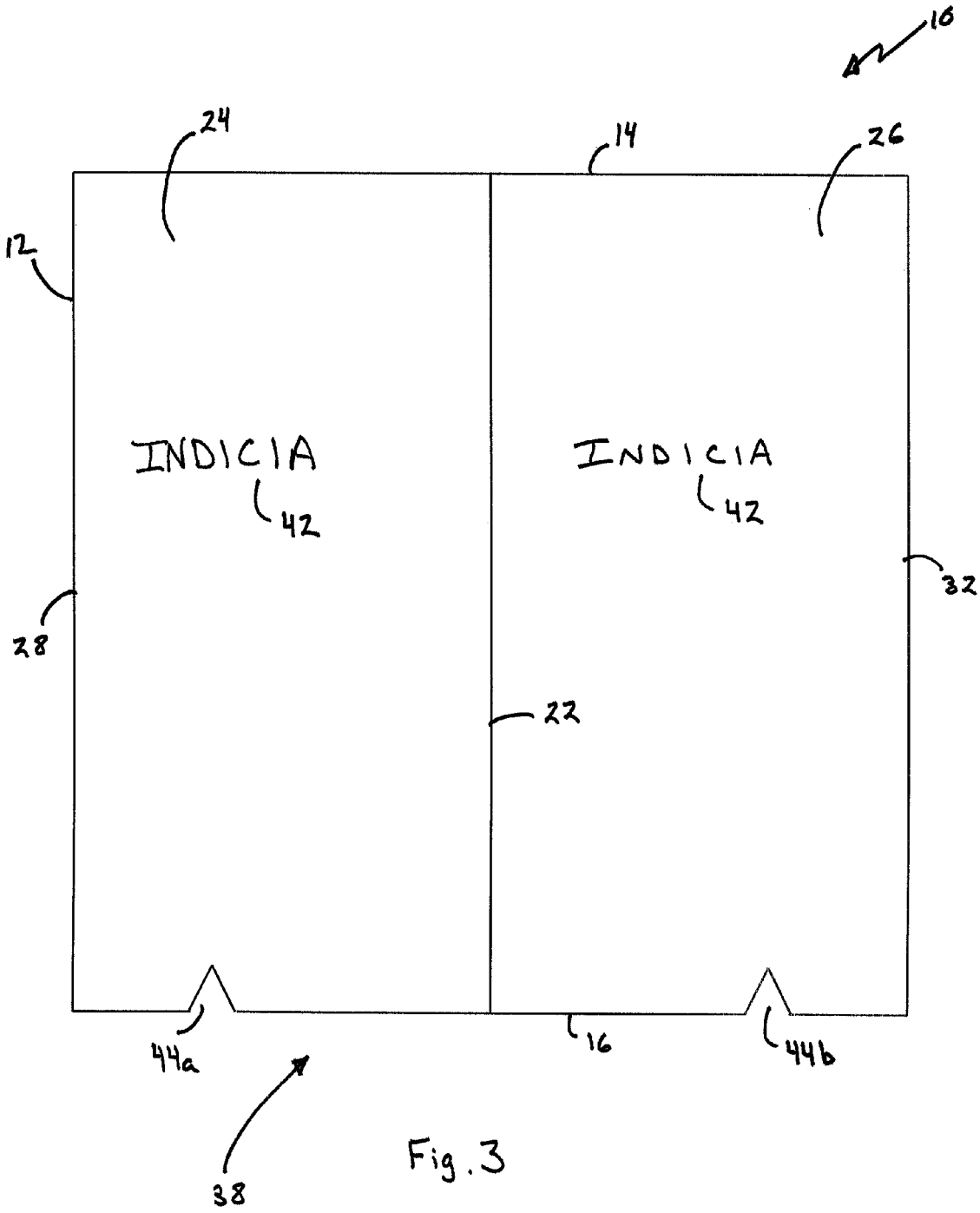
FIG. 3 is a front elevational view of the disclosed display depicted in the folded configuration.

Referring to FIGS. 2 and 3, the front face 38 of the body 12 may include various advertising or informational indicia 42, such as graphics, text and the like. The indicia 42 may be printed, painted, drawn, embossed, written, or otherwise marked directly on the front face 38 of the substrate material of the body 12. The indicia 42 may be applied prior to or after application of any coating of the substrate material.

The indicia 42 may be positioned generally within an area defined by the first panel 24 and the second panel 26. In one implementation, the indicia 42 displayed on the first panel 24 may be identical to the indicia 42 displayed on the second panel 26. In another implementation, the indicia 42 displayed on the first panel 24 may be different than the indicia 42 displayed on the second panel 26. In another implementation, a selected one of the panels 24, 26 may include indicia 42 while the opposing panel 24, 26 may not include indicia 42.

Referring to FIG. 10, in addition to the indicia 42 (FIG. 2), one or both of the first panel 24 and second panel 26 may include additional advertising or informational dispensing devices 48 attached to a portion of their respective front face 38, such as dispensers, pockets, sleeves, and the like. The device 48 may include an adhesive-coated back surface suitable for attachment to the front face 38 of one or both of the panels 24, 26. The size of the device 48 may match the size of the panels 24, 26, may be larger, or may be smaller.

One non-limiting example of a dispensing device 48 that may be attached front face 38 of the body 12 within the area defined by either or both of the panels 24, 26 is a coupon dispenser, such as the coupon dispenser disclosed in U.S. Patent Pub. No. 2006/0011643 to Emoff et al., the entire contents of which are incorporated herein by reference. The Emoff publication discloses a disposable coupon dispenser that is particularly suitable for use outdoors because of water-resistant properties of the dispenser and the coupons.

Referring to FIG. 3, as discussed above, in one embodiment of the disclosed display 10, the body 12 may be divided generally in half by the first fold line 22 to form the first panel 24 and the second panel 26. The first fold line 22, the second fold line 28, a first portion of the first peripheral edge 14, and a first portion of the second peripheral edge 16 may define the first panel 24. The first fold line 22, the third fold line 32, a second portion of the first peripheral edge 14, and a second portion of the second peripheral edge 16 may define the second panel 26. While the present figures illustrate each panel 24, 26 as having four (4) sides and generally rectangular in shape, it can be appreciated that the panels 24, 26 may have any number of sides and any geometric shape. Additionally, the peripheral edges 14, 16, 18, 20 of the body 12 may be straight, wavy, or curved, depending on the type and overall shape of the display 10 desired.

Figure 4:
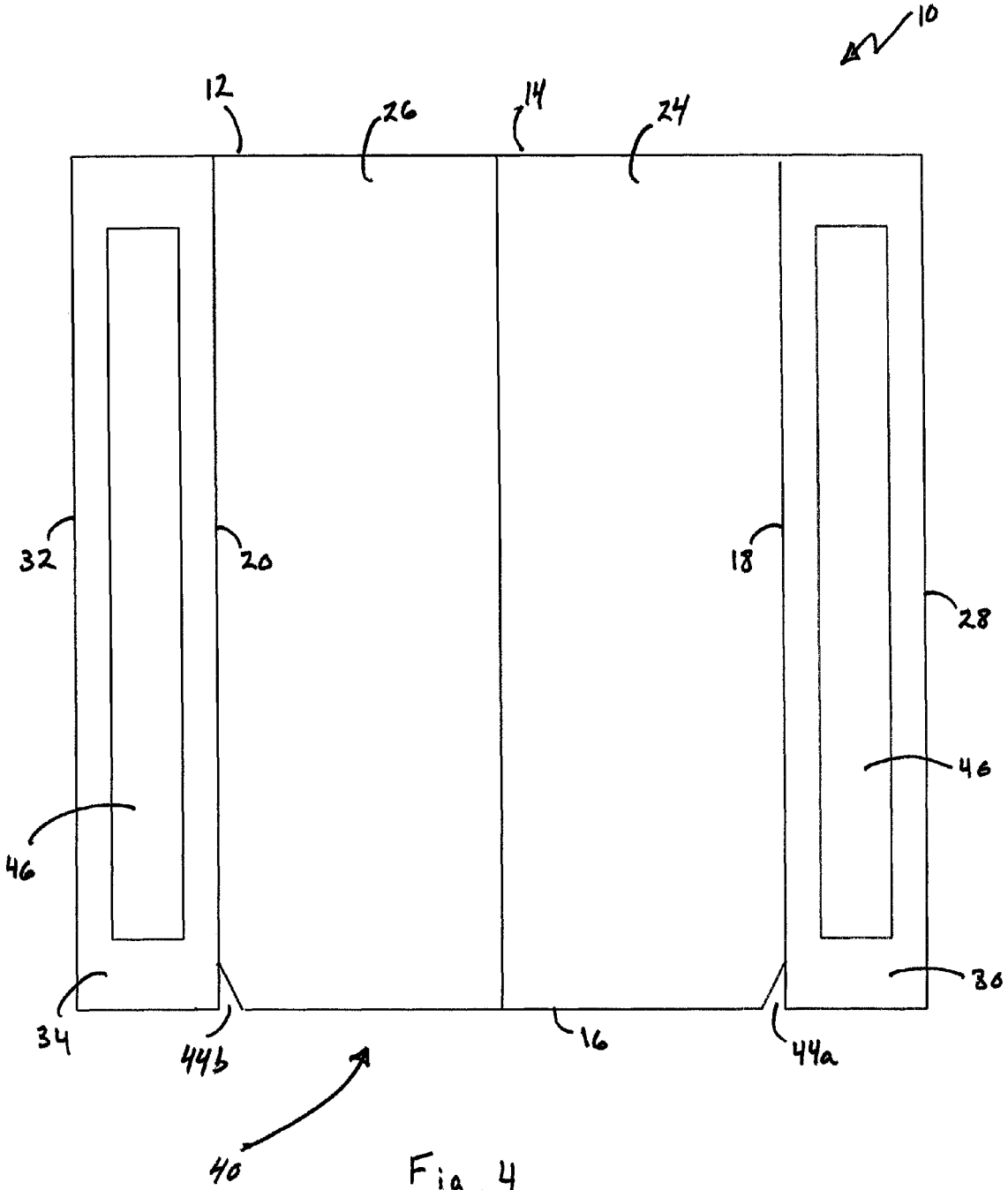
FIG. 4 is a rear elevational view of the disclosed display depicted in the folded configuration.

Referring to FIG. 4, as discussed above, in one embodiment of the disclosed display 10, the body 12 may be divided by the second fold line 22 to form the first flap 30 and the third fold line 32 to form the second flap 34. The second fold line 28, the third peripheral edge 18, a third portion of the first peripheral edge 14, and a third portion of the second peripheral edge 16 may define the first flap 30. The third fold line 32, the fourth peripheral edge 20, a fourth portion of the first peripheral edge 14, and a fourth portion of the second peripheral edge 16 may define the second flap 34. While the present figures illustrate each flap 30, 34 as having four (4) sides and generally rectangular in shape, it can be appreciated that the flaps 30, 34 may have any number of sides and any geometric shape.

Referring still to FIGS. 3 and 4, the body 12 may include a pair of notches 44 (identified individually as a first notch 44*a* and a second notch 44*b*) disposed along either the first peripheral edge 14 or the second peripheral edge 16. While the present figures illustrate the notches 44 disposed along the second peripheral edge 16, it can be appreciated by one skilled in the art that the notches 44 may be disposed along the first peripheral edge 14 with equal effect and benefit. For example, the first notch 44*a* may be formed in the lower end of the first panel 24 along the first portion of the second peripheral edge 16. The second notch 44*b* may be formed in the lower end of the second panel 26 along the second portion of the second peripheral edge 16.

Each notch 44 may include a generally triangularly shaped cutout formed in the panel 24, 26. However, those skilled in the art will appreciate that notches 44 having various shapes and configurations (e.g., rectangular) may be used without departing from the scope of the present disclosure.

Figure 5:
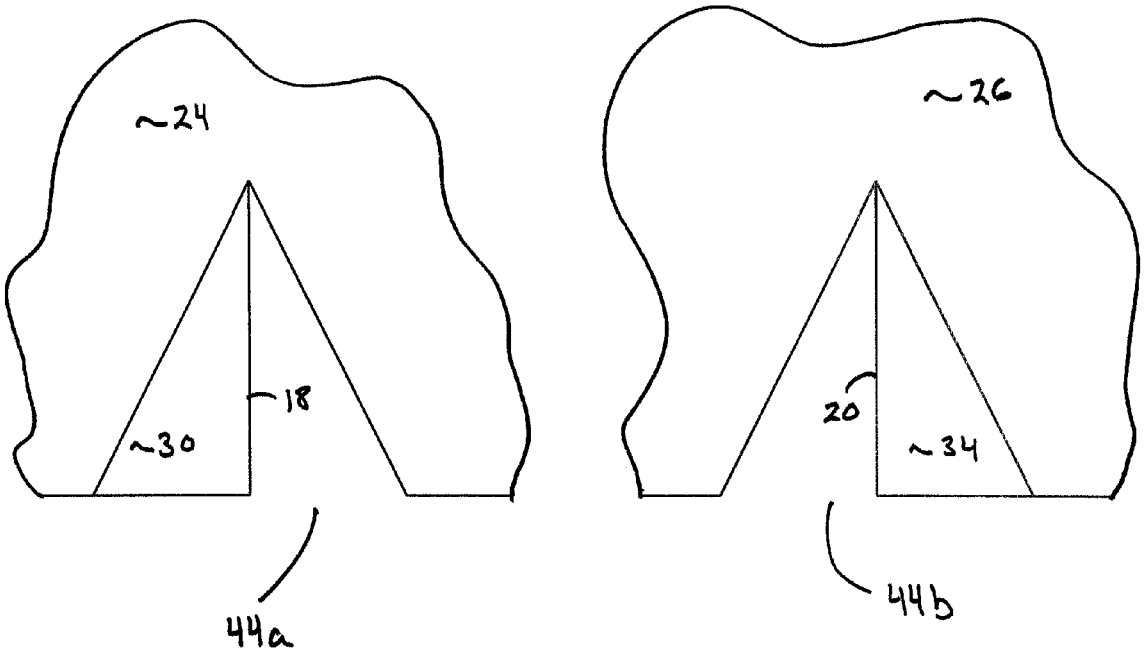
FIG. 5 is a close up view of a pair of notches of the disclosed display.
Figure 6:
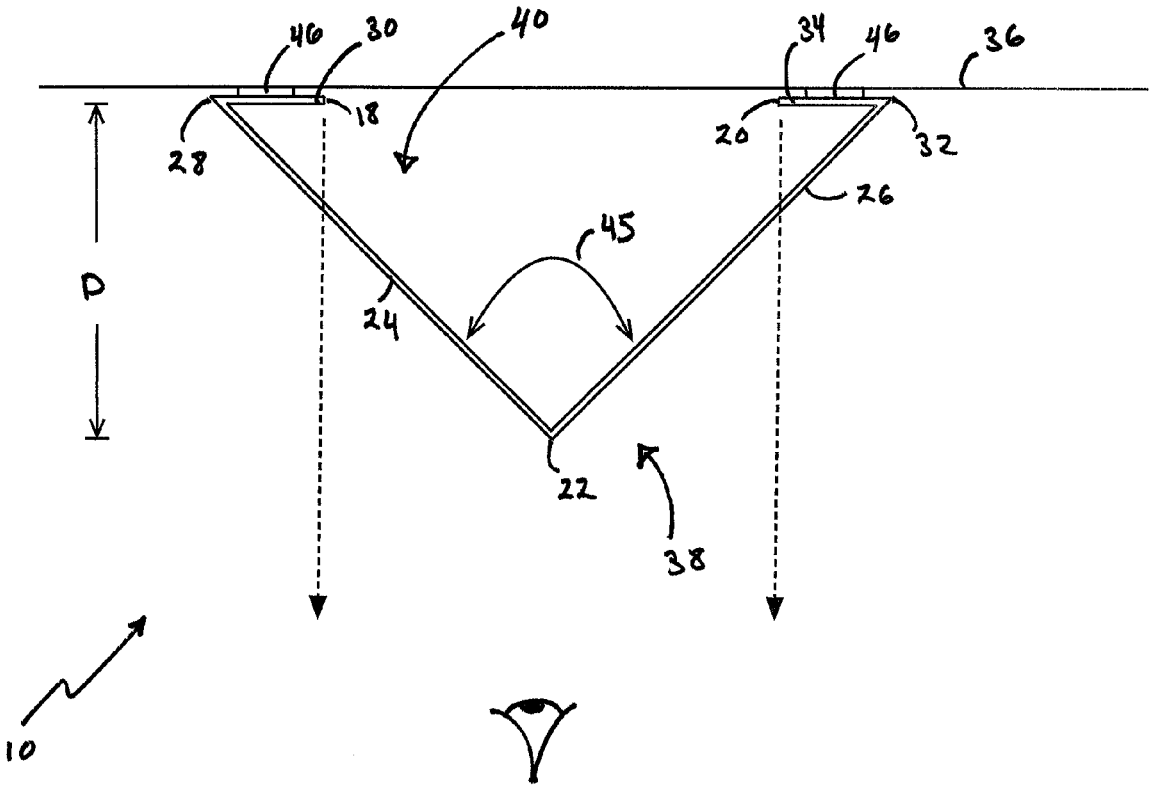
FIG. 6 is a top plan view of the disclosed display of FIG. 2.

Referring to FIGS. 5 and 6, when the body 12 is folded and attached to the support surface 36 (FIG. 2), the notches 44 may act as an alignment guide to sight in and position the flaps 30, 34. When applying the display 10 to the support surface 36, the display 10 may be viewed straight on from the front, as illustrated in FIG. 6. As illustrated in FIG. 5, a portion the first flap 30 may be visible through the first notch 44*a* and the third peripheral edge 18 may be centrally aligned within the first notch 44*a*. A portion the second flap 34 may be visible through the second notch 44*b* and the fourth peripheral edge 20 may be centrally aligned within the second notch 44*b*. Alignment of the peripheral edges 18, 20 within the notches 44*a*, 44*b* may provide for a defined angle 45 (FIG. 6) between the panels 24, 26 and a symmetric shape of the body 12 when attached to the support surface 36 (FIG. 2). This also provides for a set configuration in order to create a consistent visual appearance when a plurality of displays 10 is used in close proximity.

Figure 7:
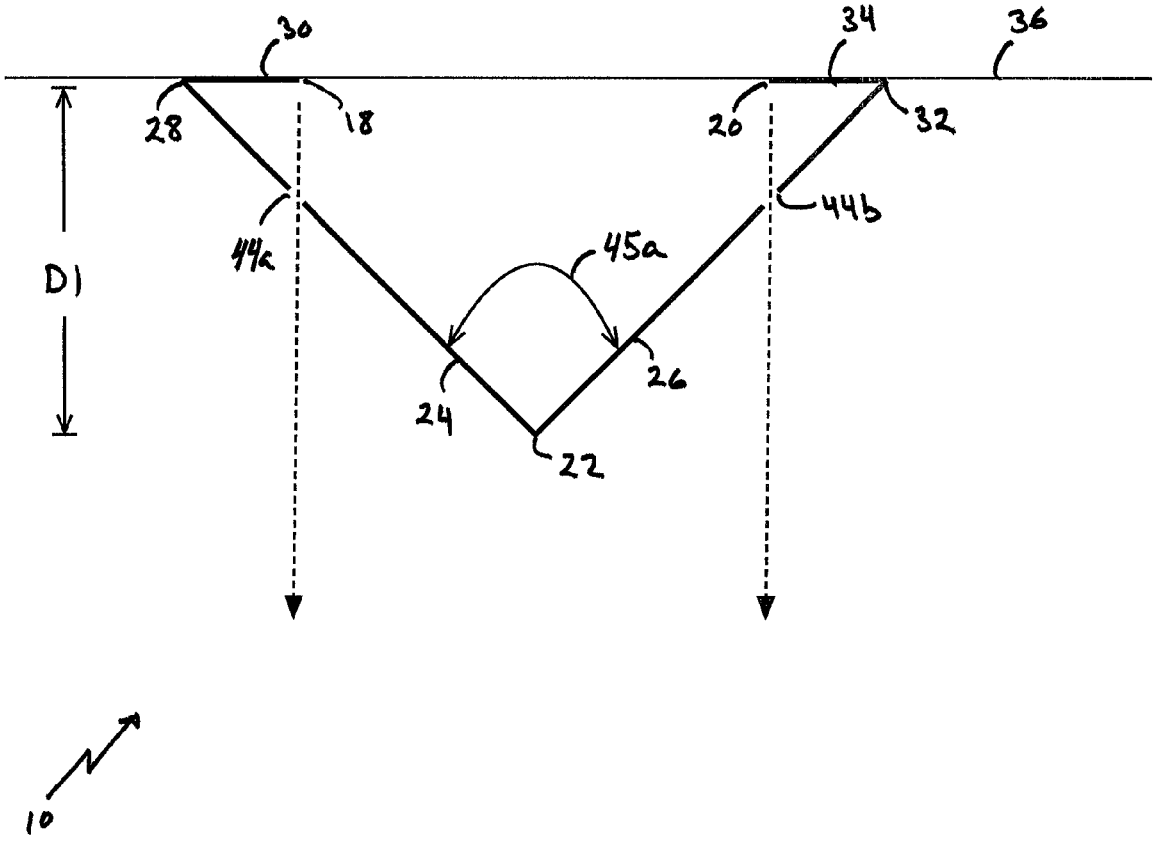
FIGS. 7-9 are schematic illustrations of various example implementations of the disclosed display.
Figure 8:
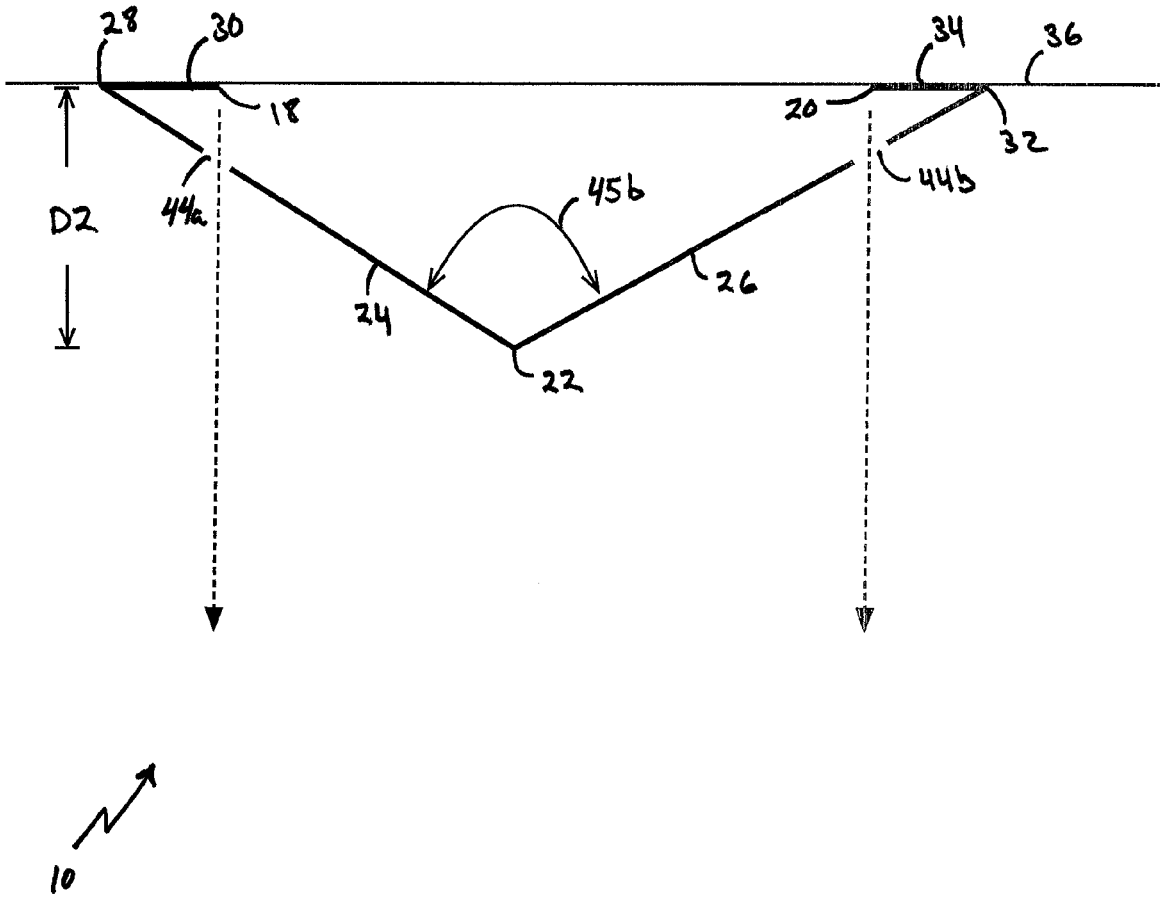
Figure 9:
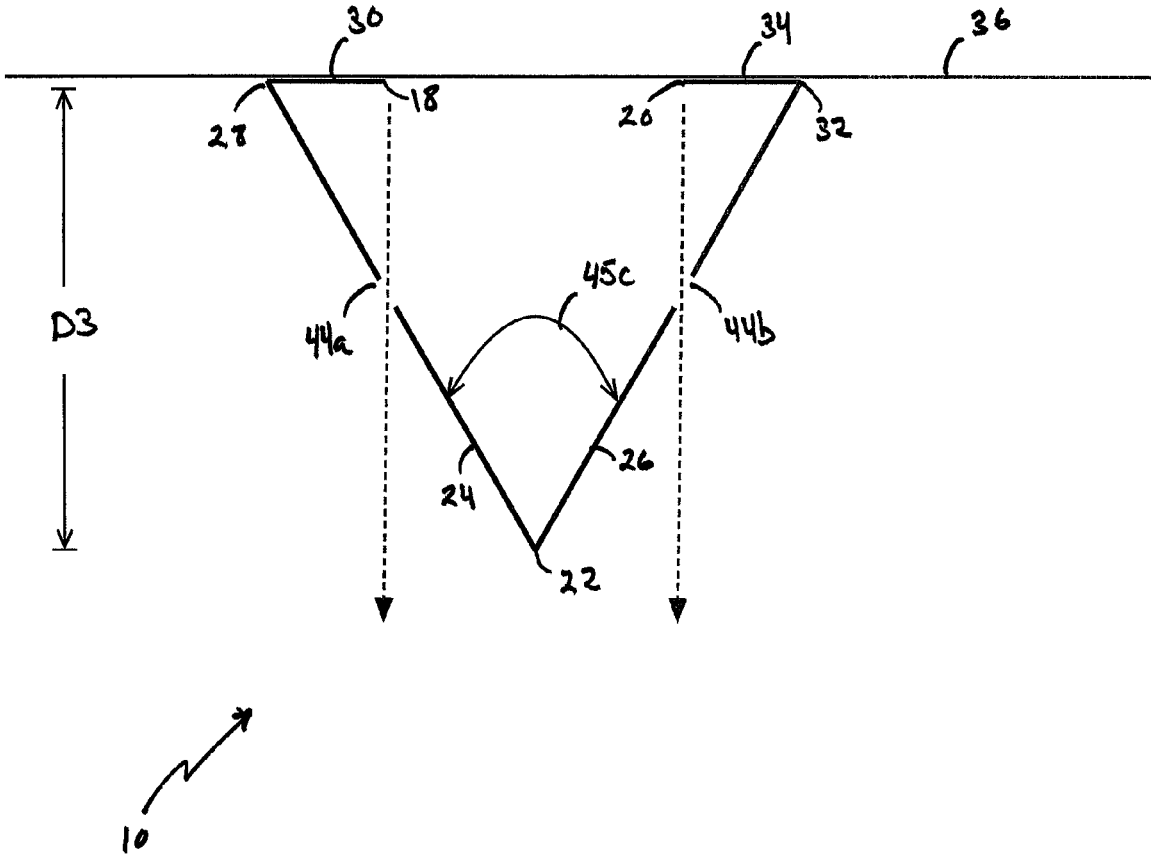

Referring to FIGS. 7-9, the position of the notches 44 along the second peripheral edge 16 may define the angle 45 between the first panel 24 and the second panel 26. Generally, the angle 45 may define the distance D that the display extends away from the support surface 36. For example, as illustrated in FIG. 7, when the notches 44 are positioned at a first location along the second peripheral edge 16, a first angle 45*a* is created and the display 10 may extend a first distance D1 from the support surface 36. As illustrated in FIG. 8, when the notches 44 are positioned at a second location along the second peripheral edge 16 farther from the first fold line 22, a second angle 45*b* may be created that is larger than the first angle 45*a* and the display 10 may extend a second distance D2 from the support surface 36 that is smaller than the first distance D1. As illustrated in FIG. 9, when the notches 44 are positioned at a third location along the second peripheral edge 16 closer to the first fold line 22, a third angle 45*c* may be created that is smaller than the first angle 45*a* and the display may extend a third distance D3 from the support surface 36 that is larger than the first distance D1.

Referring to FIGS. 4 and 6, the body 12 may include an adhesive 46. The adhesive 46 may be positioned on the front face 38 within an area defined by the first flap 30 and the second flap 34 in such a way that when the body 12 is folded along the fold lines 22, 28, 32, the adhesive 46 faces outwardly. The outwardly facing orientation of the adhesive 46 may facilitate attachment of the display 10 to the support surface 36 (e.g., a wall, a door, a window, a shelf, a gas pump, and the like), thereby fixing the first panel 24 at the desired angle 45 relative to the second panel 26.

The adhesive 55 may be any adhesive suitable for affixing the display 10 to support surface 36 capable of holding the display 10. Examples of suitable adhesives may include, but are not limited to; tape (e.g., double-sided tape), glue, or any other chemically bonded adhesive material. As an alternative to adhesives, those skilled in the art will appreciate that other means of fixture may also be used, such as nails, screws, staples and the like.

The adhesive 46 may include varying numbers of adhesive areas affixed to or otherwise disposed on the flaps 30, 34. Furthermore, the size and shape of the adhesive 46 may be any suitable size and shape, and the size and shape of particular adhesives 46 may vary on the same display 10. The adhesive 46 may cover the entire front face 38 of the flaps 30, 34 or alternatively may only cover a portion of the front face 38 of the flaps 30, 34.

As a particular, non-limiting example, the adhesive 46 may include a very high bond (VHB) adhesive product. For example, the adhesive 46 may be a very high bond adhesive tape that is stretchable to break the bond with the underlying support surface 36, such as style VHB 4951 adhesive tape provided by 3M Company. Such a VHB adhesive tape may very securely hold the display 10 to the support surface 36 (e.g., a glass door of a cooler or freezer) when an advertisement, flyer, credit card application, or other product, literature, or material is removed from the display 10, such as products or materials stored in the dispensing device 48 (FIG. 10). To remove the adhesive 46, a corner may simply need to be partially peeled and pulled, which may cause the adhesive 46 (i.e., tape) to expand or stretch to release the bond between the display 10 and the support surface 36.

Thus, a stretchable VHB adhesive tape, such as VHB 4951 adhesive tape, may provide a strong bond to the support surface 36, but may be quickly and easily removable from the support surface 36 by stretching the adhesive tape to break the bond. Additionally, a stretchable VHB adhesive tape, such as VHB 4951 adhesive tape, may leave little (or no) residue on the support surface 36 after removal.

As another particular, non-limiting example, the front face 38 of the flaps 30, 34 may be flood printed with ink or other coating to which the adhesive 46 may be applied. For example, adhesive 46 may not adequately adhere to certain corrugated substrate materials, such as polymeric corrugated board. Printing ink or similar exterior coatings bond well with polymeric corrugated board and the adhesive 46 may more securely bond to such ink or coating. Once the adhesive 46, such as the 3M style VHB 4951 tape discussed above, bonds to the coated front face 38 of the flaps 30, 34, it provides a secure adhesive bond between the display 10 and the support surface 36. Alternatively, the entire body 12 may be flood printed with the ink or other coating.

Figure 11:
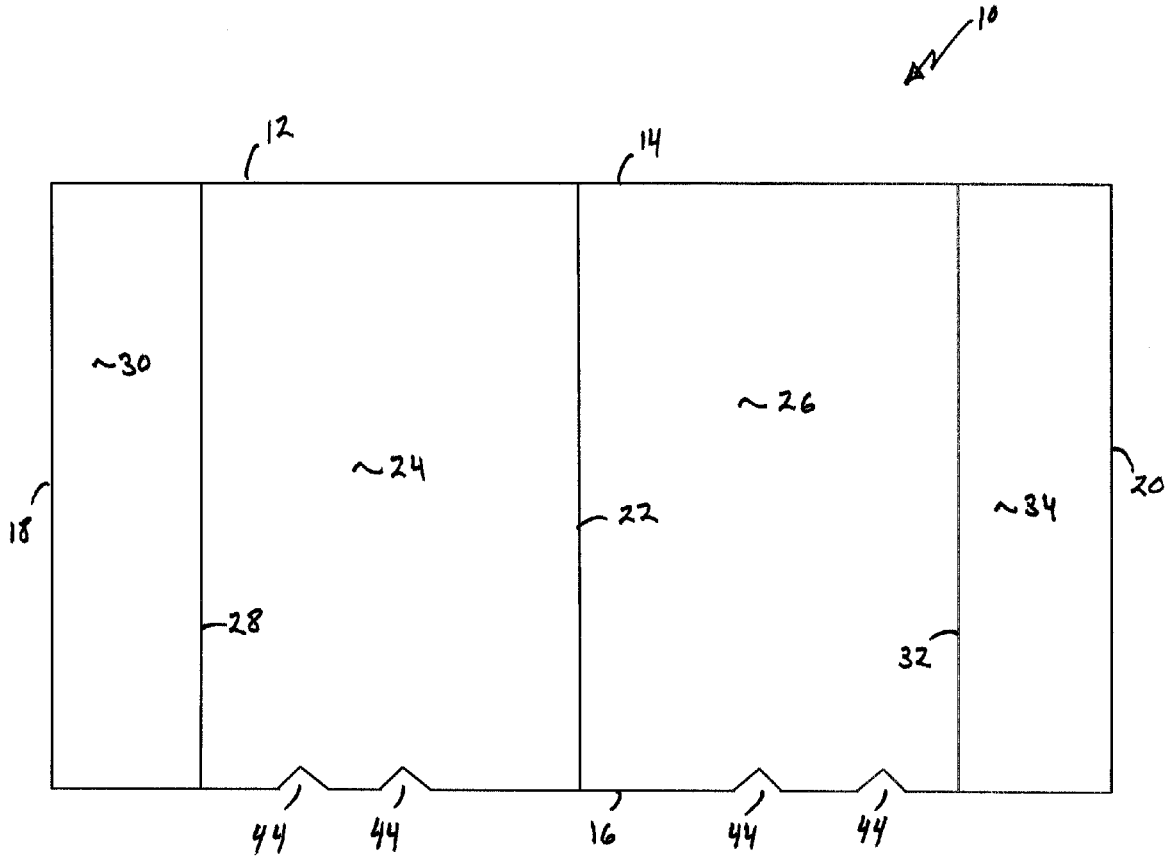
FIG. 11 is a front elevational view of another embodiment of the disclosed display depicted in the unfolded configuration.

Referring to FIG. 11, in another embodiment of the display 10, the body 12 may include a plurality of spaced apart notches 44 disposed along the second peripheral edge 16. While the present figure illustrate the notches 44 disposed along the second peripheral edge 16, it can be appreciated by one skilled in the art that the notches 44 may be disposed along the first peripheral edge 14 with equal effect and benefit. When the body 12 is folded and attached to the support surface 36 (FIG. 2), a pair of corresponding notches 44 of the plurality of notches 44 may be act as an alignment guide to sight in and position the flaps 30, 34. Any given pair of selected corresponding notches 44 may define a particular angle 45 and distance D (FIG. 6).

It can be appreciated by one skilled in the art that when each notch 44 or pair of notches 44 is positioned at an equal distance from the first fold line 22, the folded body 12 may form a symmetric shape. It can also be appreciated that when each notch 44 pair of notches 44 is positioned at an unequal distance from the first fold line 22, the folded body 12 may form an asymmetric shape.

Further, it can be appreciated by one skilled in the art that the same effect of defining the angle 45 and distance D by changing the location of the notches 44 along the first peripheral edge 14 or the second peripheral edge 16 may be achieved by changing the width of the first flap 30 and the second flap 34. The width of the flaps 30, 34 may be changed by changing the position of the second fold line 28 and the third fold line 32 relative to the first fold line 22 or by trimming the third peripheral edge 18 and fourth peripheral edge 20.

Once the display 10 has been folded about the fold lines 22, 28, 32, the display 10 may be connected to the support surface 36. A method for connecting the display 10 to the support surface 36 may begin by exposing the adhesive 46 of the first flap 30, for example by peeling away a removable protective layer to expose the adhesive 46. The first flap 30 may then be connected to the support surface 36. The adhesive 46 of the second flap 34 may then be exposed. The third peripheral edge 18 may then be aligned within the first notch 44*a*. The fourth peripheral edge 20 may then be aligned within the second notch 44*b*. When the third and fourth peripheral edges 18, 20 are aligned, the second flap 34 may be connected to the support surface 36 generally parallel with the first flap 30, thus securing the display 10 to the support surface 36 with the first panel 24 at a defined angle 45 relative to the second panel 26. Additional displays 10 may be connected to additional support surfaces 36 in a like manner to create a plurality of consistently shaped displays 10 extending at substantially similar distances D from the support surfaces 36.

Although various aspects of the disclosed display have been shown and described, modifications may occur to those skilled in the art upon reading the specification. The present application includes such modifications and is limited only by the scope of the claims.

What is claimed is:

1. A display comprising:

a body comprising:

a first peripheral edge;

a second peripheral edge opposite said first peripheral edge;

a third peripheral edge extending between said first and said second peripheral edges;

a fourth peripheral edge extending between said first and said second peripheral edges opposite said third peripheral edge;

a first fold line;

a second fold line spaced apart from said first fold line;

a third fold line spaced apart from said first fold line opposite said second fold line;

a first notch disposed along one of said first peripheral edge and said second peripheral edge between said first fold line and said second fold line;

a second notch disposed along one of said first peripheral edge and said second peripheral edge between said first fold line and said third fold line;

a first panel defined by said first fold line and said second fold line;

a second panel defined by said first fold line and said third fold line, said second panel being foldable to a predetermined angle relative to said first panel along said first fold line;

a first flap defined by said second fold line and said third peripheral edge, said first flap being inwardly foldable relative to said first panel along said second fold line and said third peripheral edge being centrally aligned visually through said first notch to set said first panel at said predetermined angle; and a second flap defined by said third fold line and said fourth peripheral edge, said second flap being inwardly foldable relative to said second panel along said third fold line and said fourth peripheral edge being centrally aligned visually through said second notch to set said second panel at said predetermined angle.

2. The display of claim 1 wherein said first notch comprises a triangular shaped cutout disposed in said first panel and said second notch comprises a triangular shaped cutout disposed in said second panel.

3. The display of claim 1 wherein a distance between said first notch and said first fold line is substantially equal to a distance between said second notch and said first fold line.

4. The display of claim 1 wherein said body further comprises a plurality of first notches disposed along one of said first and said second peripheral edges between said first fold line and said second fold line and a plurality of second notches disposed along one of said first and said second peripheral edges between said first fold line and said third fold line.

5. The display of claim 1 further comprising a first adhesive connected to said first flap and a second adhesive connected to said second flap.

6. The display of claim 5 wherein at least one of said first adhesive and said second adhesive comprises a stretchable very high bond adhesive tape.

7. The display of claim 1 wherein said body comprises a front surface, and wherein said front surface of at least one of said first panel and said second panel is marked with indicia.

8. The display of claim 1 further comprising a dispensing device connected to at least one of said first panel and said second panel.

9. A folded display comprising:

a body comprising:

a first peripheral edge;

a second peripheral edge opposite said first peripheral edge;

a third peripheral edge extending between said first and said second peripheral edges;

a fourth peripheral edge extending between said first and said second peripheral edges opposite said third peripheral edge;

a first panel;

a second panel coupled to said first panel, said second panel being folded at a predetermined angle relative to said first panel;

a first notch disposed in said first panel along one of said first peripheral edge and said second peripheral edge;

a second notch disposed in said second panel along one of said first peripheral edge and said second peripheral edge;

a first flap coupled to said first panel, said first flap being inwardly folded relative to said first panel to centrally align said third peripheral edge visually through said first notch and set said first panel at said predetermined angle;

a second flap coupled to said second panel, said second flap being inwardly folded relative to said second panel to centrally align said fourth peripheral edge visually through said second notch and set said second panel at said predetermined angle.

10. The display of claim 9 wherein said first notch comprises a triangular shaped cutout disposed in said first panel and said second notch comprises a triangular shaped cutout disposed in said second panel.

11. The display of claim 10 wherein a distance between said first notch and said third peripheral edge is substantially equal to a distance between said second notch and said fourth peripheral edge.

12. The display of claim 9 further comprising a first adhesive connected to said first flap and a second adhesive connected to said second flap.

13. The display of claim 9 wherein said body comprises a front surface, and wherein said front surface of at least one of said first panel and said second panel is marked with indicia.

14. The display of claim 9 further comprising a dispensing device connected to at least one of said first panel and said second panel.

15. A display comprising:

a first panel;

a second panel connected to said first panel along a first fold line, said first panel and said second panel being foldable to a predetermined angle relative to each other along said first fold line;

a first notch disposed on a peripheral edge of said first panel;

a second notch disposed on a peripheral edge of said second panel;

a first flap connected to said first panel along a second fold line parallel to and spaced apart from said first fold line, said first flap comprising a peripheral edge opposite said second fold line, said first flap being inwardly foldable relative to said first panel along said second fold line and said peripheral edge of said first flap being centrally aligned visually through said first notch to set said first panel at said predetermined angle; and a second flap connected to said second panel along a third fold line parallel to and spaced apart from said first fold line, said second flap comprising a peripheral edge opposite said third fold line, said second flap being inwardly foldable relative to said second panel along said third fold line and said peripheral edge of said second panel being centrally aligned visually through said second notch to set said second panel at said predetermined angle.

16. The display of claim 15 wherein said first notch comprises a triangular shaped cutout disposed in said first panel and said second notch comprises a triangular shaped cutout disposed in said second panel.

17. The display of claim 15 wherein a distance between said first notch and said first fold line is substantially equal to a distance between said second notch and said first fold line.

18. The display of claim 15 further comprising a first adhesive connected to said first flap and a second adhesive connected to said second flap.

19. The display of claim 15 further comprising a dispensing device connected to at least one of said first panel and said second panel.

* * * * *